US006599009B2

(12) United States Patent
Terasawa et al.

(10) Patent No.: US 6,599,009 B2
(45) Date of Patent: Jul. 29, 2003

(54) WRISTWATCH CASE HAVING A ROTARY BEZEL

(75) Inventors: Dai Terasawa, Chiba (JP); Toshiaki Kume, Chiba (JP); Masayuki Kimura, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/819,478

(22) Filed: Mar. 28, 2001

(65) Prior Publication Data

US 2001/0040840 A1 Nov. 15, 2001

(51) Int. Cl.[7] ..... G04B 37/00
(52) U.S. Cl. ..... 368/295; 368/294
(58) Field of Search ..... 368/294, 295, 368/296

(56) References Cited

U.S. PATENT DOCUMENTS

| | | | | | |
|---|---|---|---|---|---|
| 4,420,264 | A | * | 12/1983 | Murata | 368/223 |
| 4,975,893 | A | * | 12/1990 | Dal Busco | 368/294 |
| 5,122,997 | A | * | 6/1992 | Schneider et al. | 368/294 |
| 5,319,617 | A | * | 6/1994 | Sonoda | 368/294 |
| 5,541,895 | A | * | 7/1996 | Nussbaum | 368/295 |
| 5,654,941 | A | * | 8/1997 | Joss | 368/295 |
| 6,200,019 | B1 | * | 3/2001 | Latini | 368/295 |
| 6,379,037 | B1 | * | 4/2002 | Salch et al. | 368/294 |

FOREIGN PATENT DOCUMENTS

| | | | | |
|---|---|---|---|---|
| CH | 503306 | | 9/1970 | |
| EP | 436468 | | 7/1991 | |
| JP | 62148879 | A * | 7/1987 | 368/295 |
| JP | 402059695 | A * | 2/1990 | 368/295 |

OTHER PUBLICATIONS

Masui, Structure of Wristwatch Case, JP54155868A, Dec. 8, 1979, abstract.*

* cited by examiner

*Primary Examiner*—David Martin
*Assistant Examiner*—Jeanne-Marguerite Goodwin
(74) *Attorney, Agent, or Firm*—Adams & Wilks

(57) ABSTRACT

The rotary vessel is structured having a function movable generally vertical relative to a plane of a wristwatch case, and divided with a plurality of stop points in a movable range in a vertical direction, i.e. a stop point for securing stop stability of rotation and a stop point for rotating the rotary vessel. Due to this, in the case that the rotary vessel is in a rotatable state, rotation torque can be minimized.

20 Claims, 8 Drawing Sheets

WRISTWATCH CASE HAVING A ROTARY BEZEL

BACKGROUND OF THE INVENTION

1. Field of the Invention

The present invention relates to a wristwatch case having a rotary bezel.

2. Description of the Prior Art

It has been possible for a wristwatch case attached with a conventional rotary bezel to rotate the rotary bezel. However, the rotary bezel could not be moved in a vertical direction.

The wristwatch case attached with a conventional bezel has the following problems.

(1): Despite having a function to rotate the rotary bezel, the bezel rotation torque had to be large in order to secure stability in a stop state of the rotary bezel.

(2): Because of problem (1), a large concave-convex form must be structured on a surface of the rotary bezel.

(3): When operating the rotary bezel by the user's finger, pain is often felt in the finger.

An object of the present invention is to provide a wristwatch case attached with a rotary bezel which solves the foregoing problems and is easy to rotate without the necessity of a large rotation torque and concave-convex form on the rotary bezel surface while securing stability in a stop state of the rotary bezel.

SUMMARY OF THE INVENTION

The rotary bezel is structured having a function movable generally vertical relative to a plane of a wristwatch case, and divided with a plurality of stop points in a movable range in a vertical direction, i.e., a stop point for securing stop stability of rotation and a stop point for rotating the rotary bezel. Due to this, in the case that the rotary bezel is in a rotatable state, rotation torque can be minimized.

According to the present invention, in a stop point for securing stop stability of rotation, a gear-formed concave-convex portion provided on the rotary bezel engages the rotation regulating portion of a concave-convex-formed gear of a rotation regulating ring. In a stop point for rotation, engagement is released from the rotation regulating portion of the rotation regulating ring, minimizing rotation torque.

BRIEF DESCRIPTION OF THE DRAWINGS

A preferred form of the present invention is illustrated in the accompanying drawings in which.

DETAILED DESCRIPTION OF THE PREFERRED EMBODIMENTS

An embodiment of the present invention will be explained below with reference to the drawings.

Figure 1:
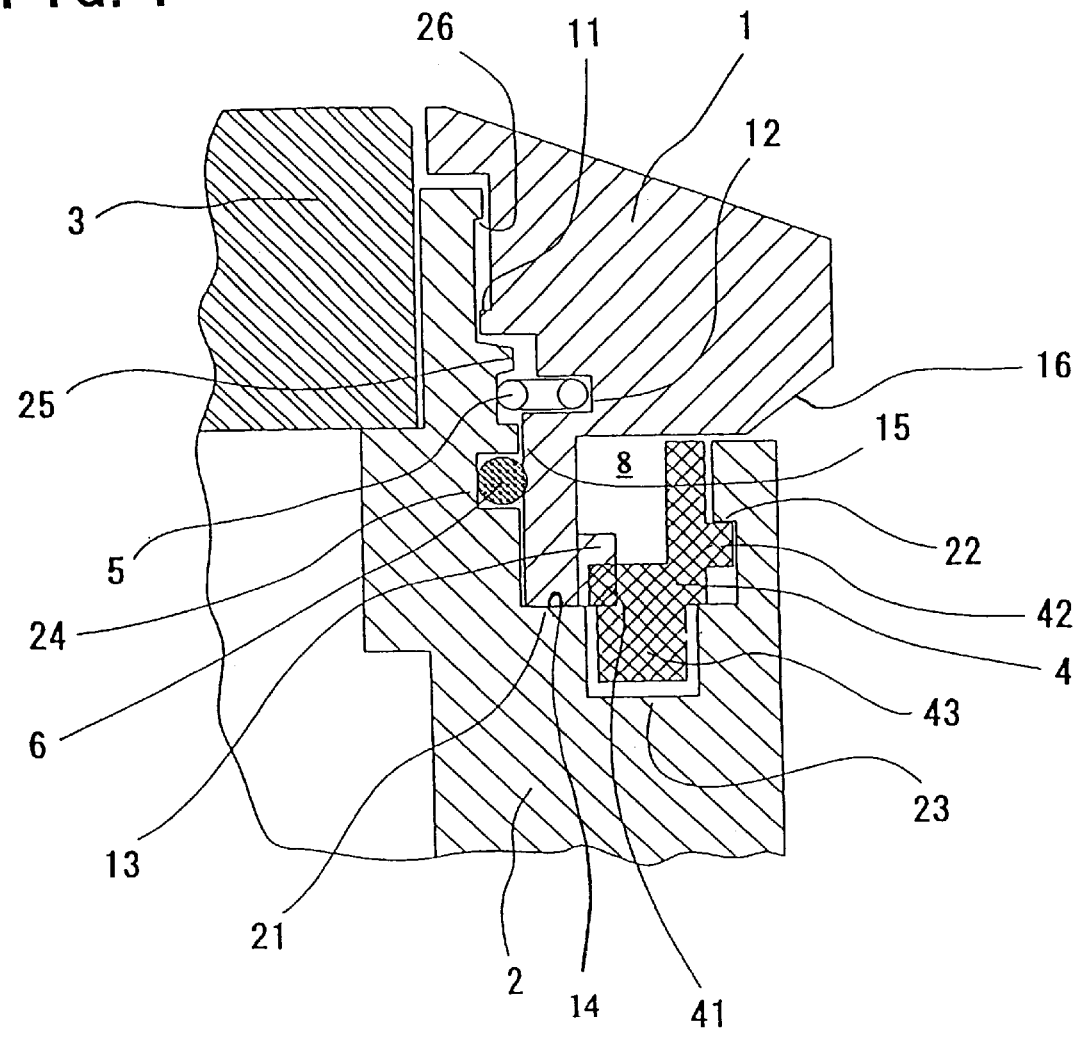
FIG. 1 is a principal-structure fragmentary sectional view of a rotary-bezel lower stop point of the present invention.

The watch case of the present invention is structured, as shown in FIG. 1, by a degree-contact step 11, a positioning groove 12 holding a positioning elastic member 5, a rotary bezel 1 having a gear-formed concave-convex portion 13 arbitrarily divided relative to a planar form, a bezel degree-contact surface 26, a case body or case barrel 2 having a positioning protrusion 25, a rotation-stop dowel or projection 43 engaged in a rotation-stop hole 23, and an elastic rotation regulating ring 4 having a rotation regulating portion 41 corresponding to the gear-formed concave-convex portion 13 and fixed on the case body or case barrel 2. As shown in the drawings, the rotation regulating ring 4 is disposed in a circumferential space 8 formed partly by the case barrel or case body 2 and partly by the rotary bezel 1. A glass 3 is attached to the case barrel 2.

FIG. 1 shows a state in which a rotary-bezel bottom surface 14 is in contact with a rotary-bezel receiving surface 21 of the case-barrel 2, the state of which is defined as a lower stop point or stop position. The rotary bezel 1 can stop at the lower stop point by the positioning elastic member 5 held by the positioning groove 12 of the rotary bezel 1 and the positioning protrusion 25 of the case barrel 2.

Figure 4:
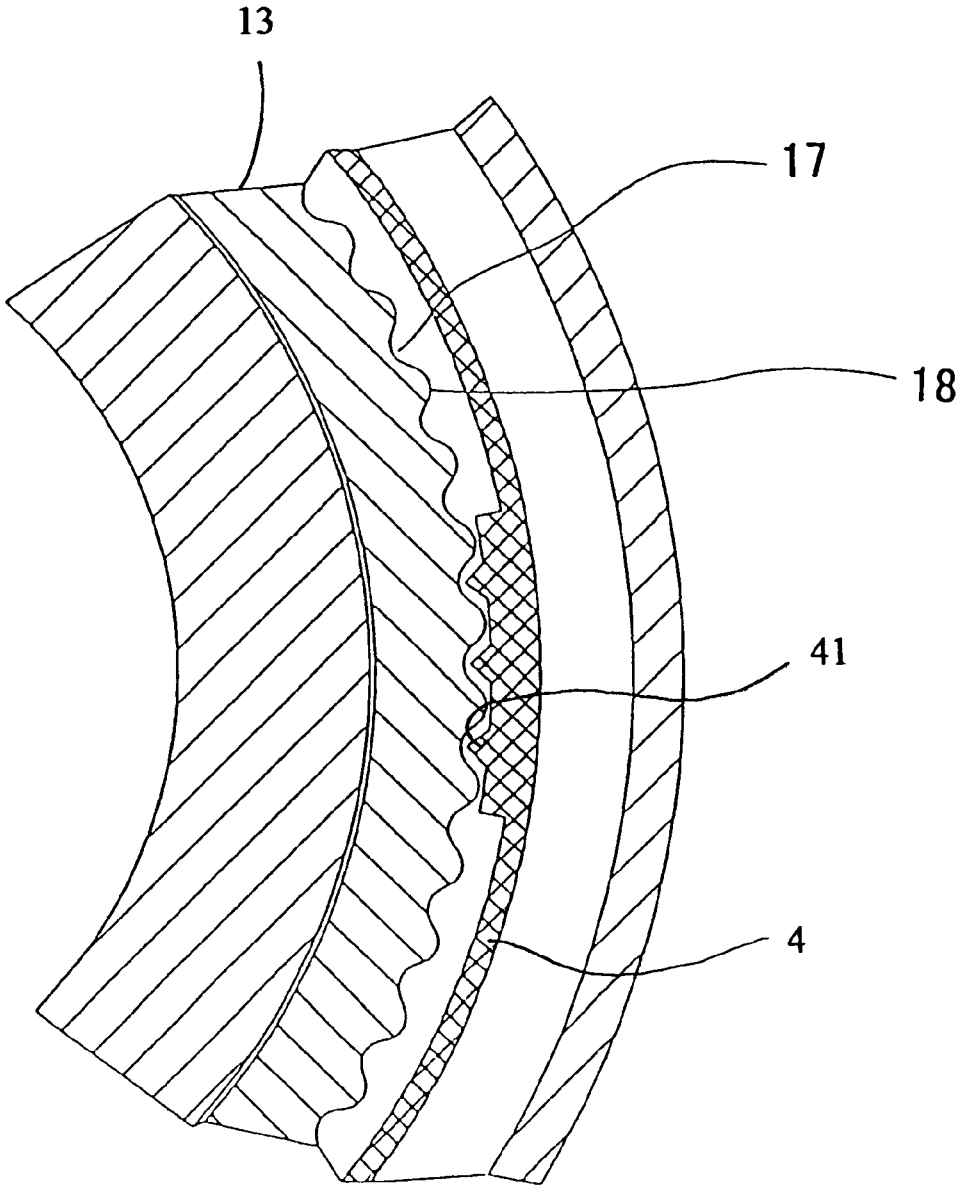
FIG. 4 is a fragmentary sectional view taken along line 4—4 of FIG. 3 in a rotary-bezel lower stop point of the invention.

The rotation regulating ring 4 does not rotate due to the engagement of the rotation stop dowel or projection 43 of the rotation regulating ring 4 with the rotation stop hole 23 formed in singular or plurality in the case barrel 2. At this time, as shown in FIG. 4, engagement is made between the gear-formed concave-convex portion 13 of the rotary bezel 1 and a toothed portion of the rotation regulating portion 41 of the rotation regulating ring 4 fixed on an inner periphery of the case barrel 2, whereby the rotation bezel 1 is secured with stop stability and not rotated.

The rotation regulating portion 41 of the rotation regulating ring 4 fixed on the case barrel 2 is also provided in singular or in plurality.

By the contact of a chatter preventing elastic member 6 fitted in the fixing groove 24 of the case-barrel 2 with an elastic contact surface 15 of the rotary bezel 1, the rotary bezel 1 is further secured with stop stability.

Figure 2:
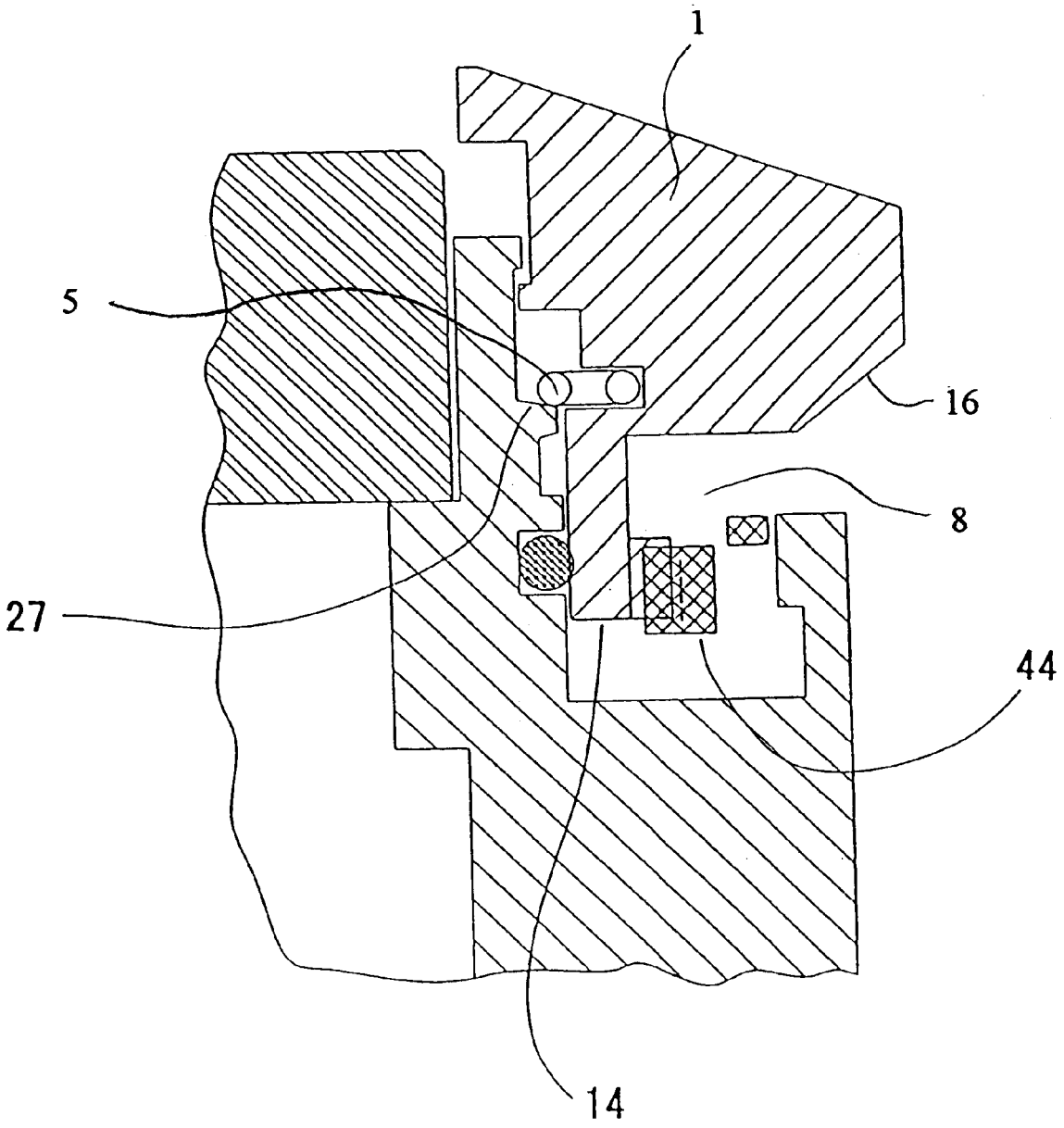
FIG. 2 is a principal-structure fragmentary sectional view of a rotary-bezel upper stop point of the invention.

FIG. 2 shows a state that, by putting the user's finger on a finger-putting slant surface 16 to vertically move or displace the rotary bezel 1, the positioning elastic member 5 held by the positioning groove 12 of the rotary bezel 1 is elastically deflected and slides over the positioning protrusion 25 of the case barrel 2. At this time, the positioning elastic member 5 held by the positioning groove 12 of the rotary bezel 1 slidably engages a protrusion upper surface 27 of the case barrel 2, whereby the rotary bezel 1 is allowed to stop at the upper stop point or stop position. Thus, the rotary bezel 1 is allowed to rotate stably in the upper stop point.

In this state, the engagement between the gear-formed concave-convex portion 13 of the rotary bezel 1 and the rotation regulating portion 41 of the rotation regulating ring 4 fixed on the case barrel 2 is completely released to allow the rotary bezel 1 to rotate freely.

Figure 7:
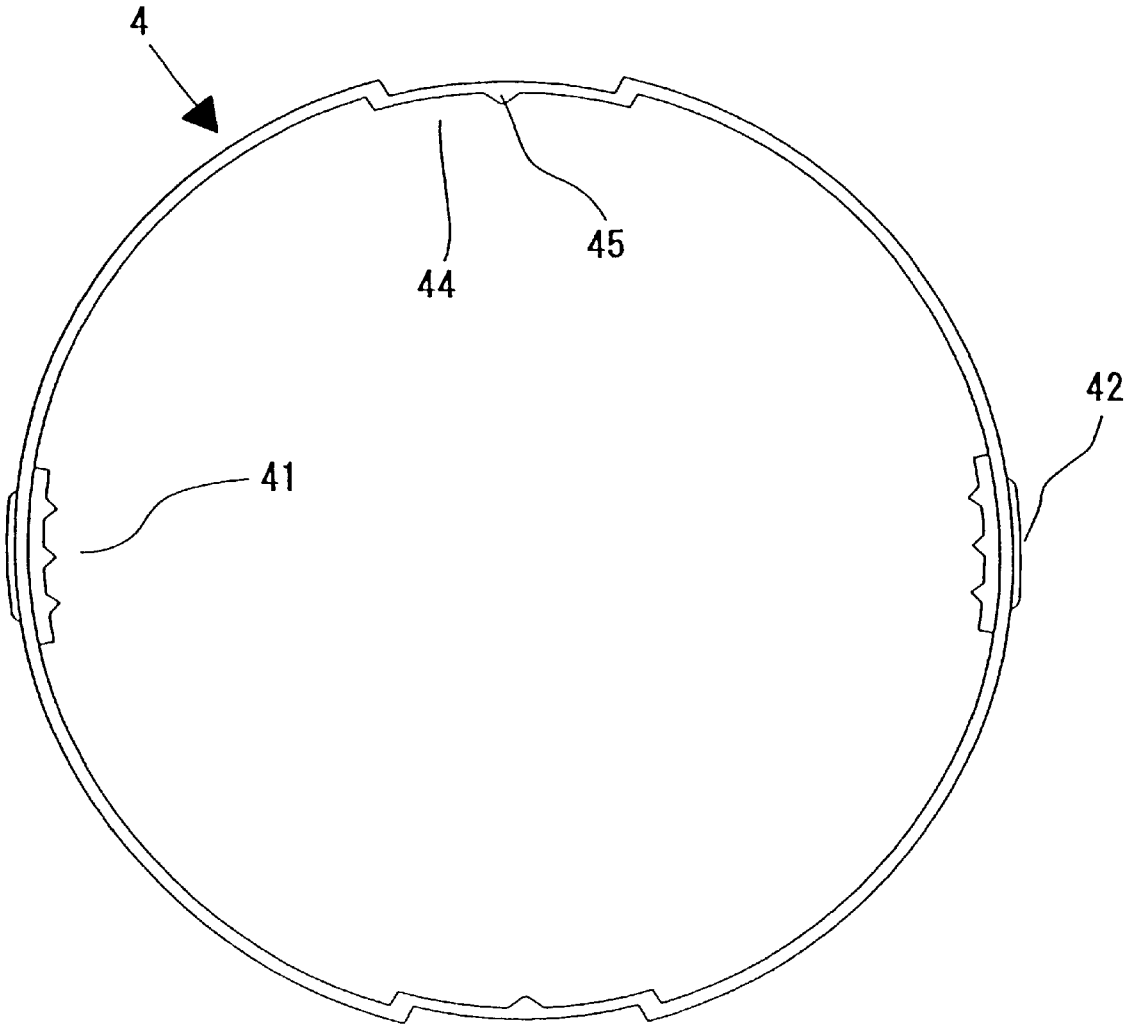
FIG. 7 is a plan view of an elastic ring of the invention.

In order to prevent the rotation regulating ring 4 fixed on the case barrel 2 from moving together with the rotary bezel 1 to the upper stop point when the rotary bezel 1 is moved or displaced to the upper stop point, the rotation regulating ring 4 has a removal preventing protrusion portion 42 which, as shown in FIG. 7, is in the form of a lip portion extending outwardly from an outer periphery of the ring 4. Due to engagement of the removal preventing protrusion portion 42 of the rotation regulating ring 4 with a circumferential groove upper wall 22 of the case barrel 2, the rotation regulating ring 4 does not move to the upper stop point.

Figure 6:
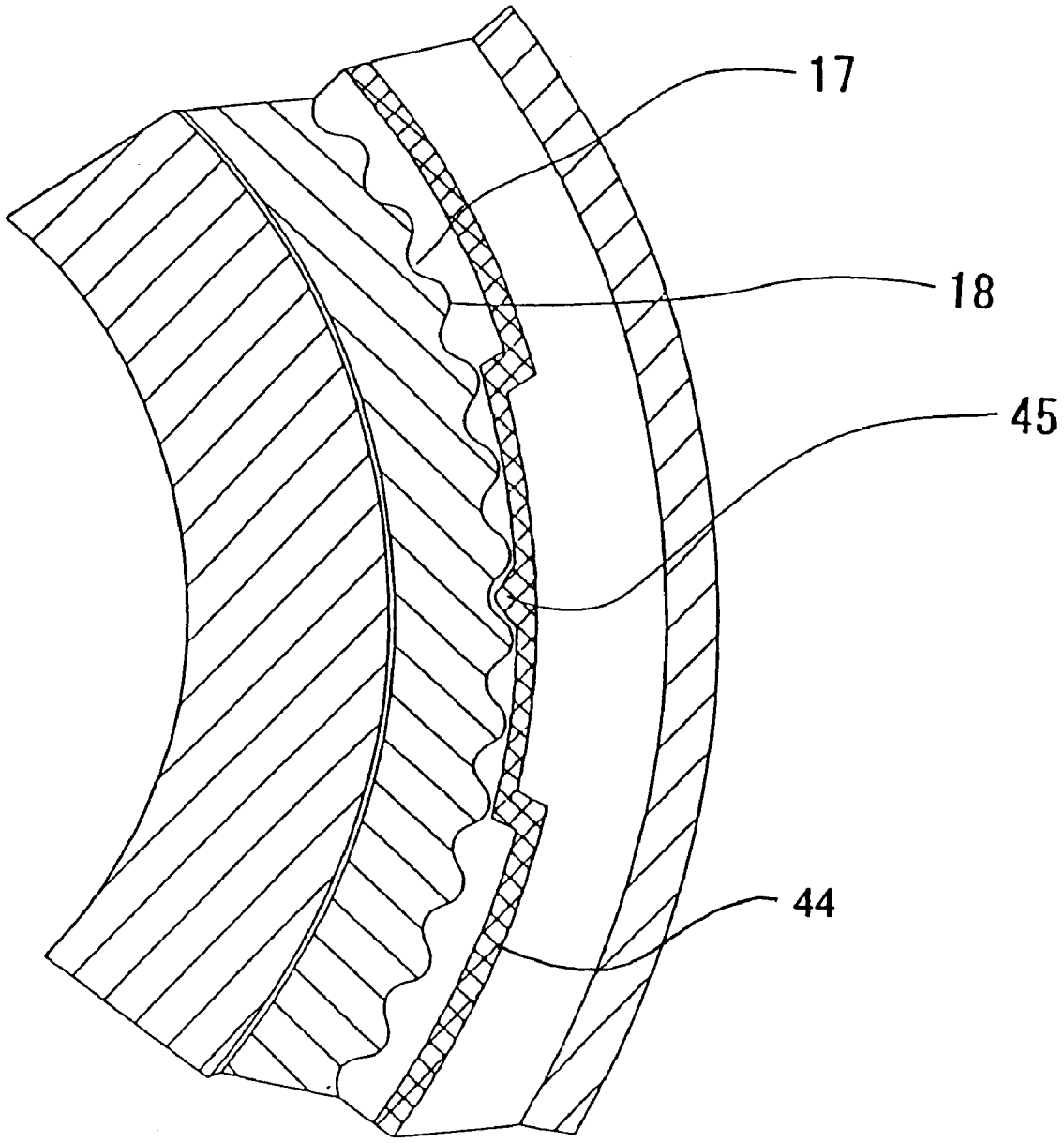
FIG. 6 is a fragmentary sectional view taken along line 6—6 of FIG. 5 in a rotary-bezel upper stop point of the invention.

As shown in FIG. 6, in the upper stop point, a gear concave portion 17 of the gear-formed concave-convex portion 13 of the rotary bezel 1 meshes with a click elastic protrusion portion 45 provided in a click elastic portion 44 of the rotation regulating ring 4 fixed on the case barrel 2.

When the rotary bezel 1 is rotated, the click elastic protrusion portion 45 provided on the click elastic portion 44 of the rotation regulating ring 4 radially moves due to a rotation force and intermittently interferes with the gear-formed concave-convex portion 13, providing a click feel to the rotary bezel 1.

The rotation regulating portion 41 of the rotation regulating ring 4 and the click elastic protrusion portion 45 are alternately arranged with respect to a plane.

Also, the rotation regulating portion 41 of the rotation regulating ring 4 and the click elastic protrusion portion 45 are arranged in upper and lower surfaces with respect to a direction of the plane.

The click elastic portion 44 of the rotation regulating ring 4 and the click elastic protrusion portion 45 are provided in a single or a plurality of positions.

In order to prevent the rotary bezel 1 from disengaging from the case barrel 2 upon moving the rotary bezel 1 in the upper direction, the rotary bezel 1 has a degree-contact step 11 and the case barrel 2 has a bezel degree-contact portion 26.

Figure 3:
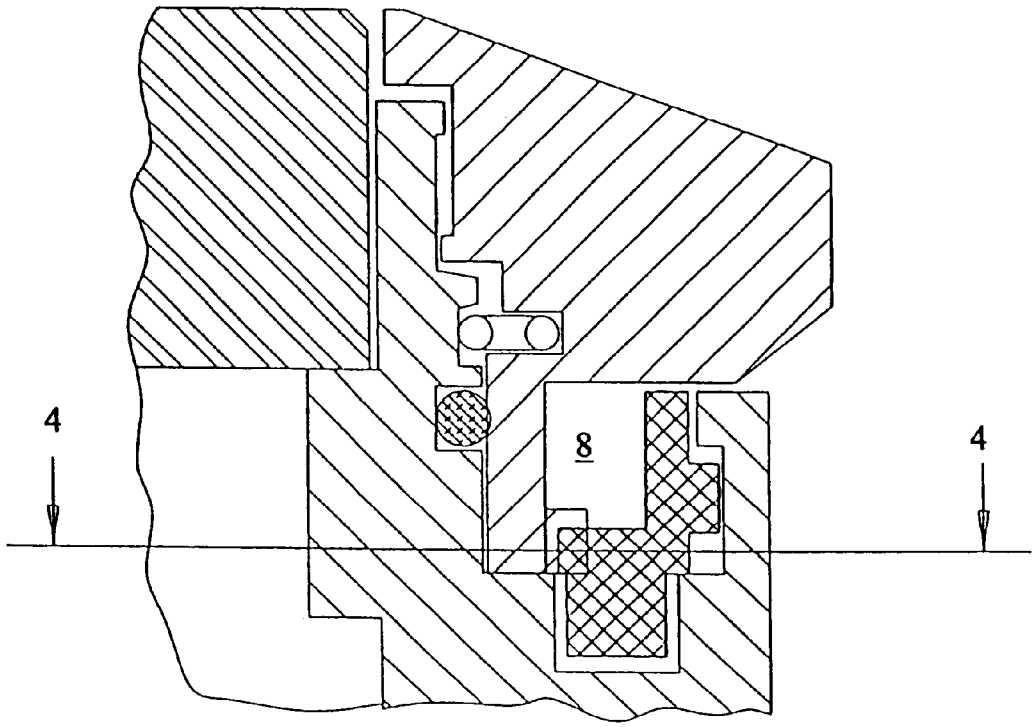
FIG. 3 is a principal-structure fragmentary sectional view of the rotary-bezel lower stop point of the invention.

FIG. 3 shows the rotary bezel 1 in the lower stop point, and FIG. 4 is a sectional view along line 4—4 in FIG. 3. The gear-formed concave-convex portion 13 having the gear concave portion 17 and the gear convex portion 18 engages the rotation-regulating portion 41 of the rotation regulating ring 4 on a plane, so the rotary bezel 1 does not rotate.

Figure 5:
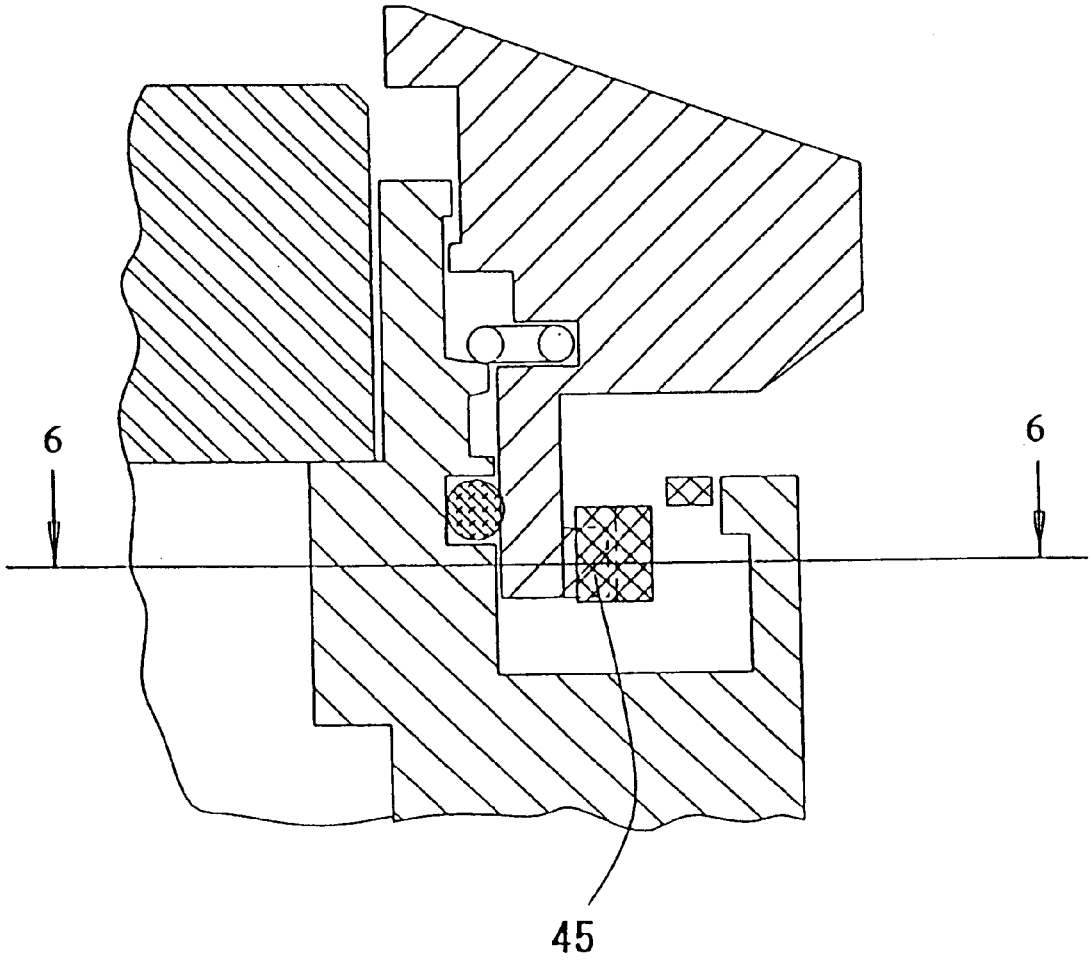
FIG. 5 is a principal-structure fragmentary sectional view of a rotary-bezel upper stop point of the invention.

FIG. 5 shows the rotary bezel 1 in the upper stop point, and FIG. 6 is a sectional view along line 6—6 in FIG. 5.

FIG. 7 shows a plan view of the rotation regulating ring 4. FIG. 7 shows a state in which the rotation-regulating portion 41 and the click elastic protrusion portion 45 are circumferentially spaced and alternately arranged on a plane. In the embodiment shown in FIG. 7, the rotation regulating ring 4 has two circumferentially spaced-apart rotation-regulation portions 41, two circumferentially spaced-apart removal preventing protrusion portions 42, and two circumferentially spaced-apart click elastic protrusion portions 45.

In this invention, as described above, a rotary bezel structure for a wristwatch case having a rotation function of the rotary bezel 1 different depending on a stop position is realized, wherein, when the rotary bezel 1 is positioned in the lower stop point, the gear-formed concave-convex portion 13 engages the rotation regulating portion 41 of the rotation regulating ring 4 to prohibit the rotary bezel 1 from rotating, while, when the rotary bezel 1 is positioned in the upper stop point, the gear-formed concave-convex portion 13 disengages from the rotation regulating portion 41 of the rotation regulating ring 4 to allow the rotary bezel 1 to rotate freely.

Figure 8:
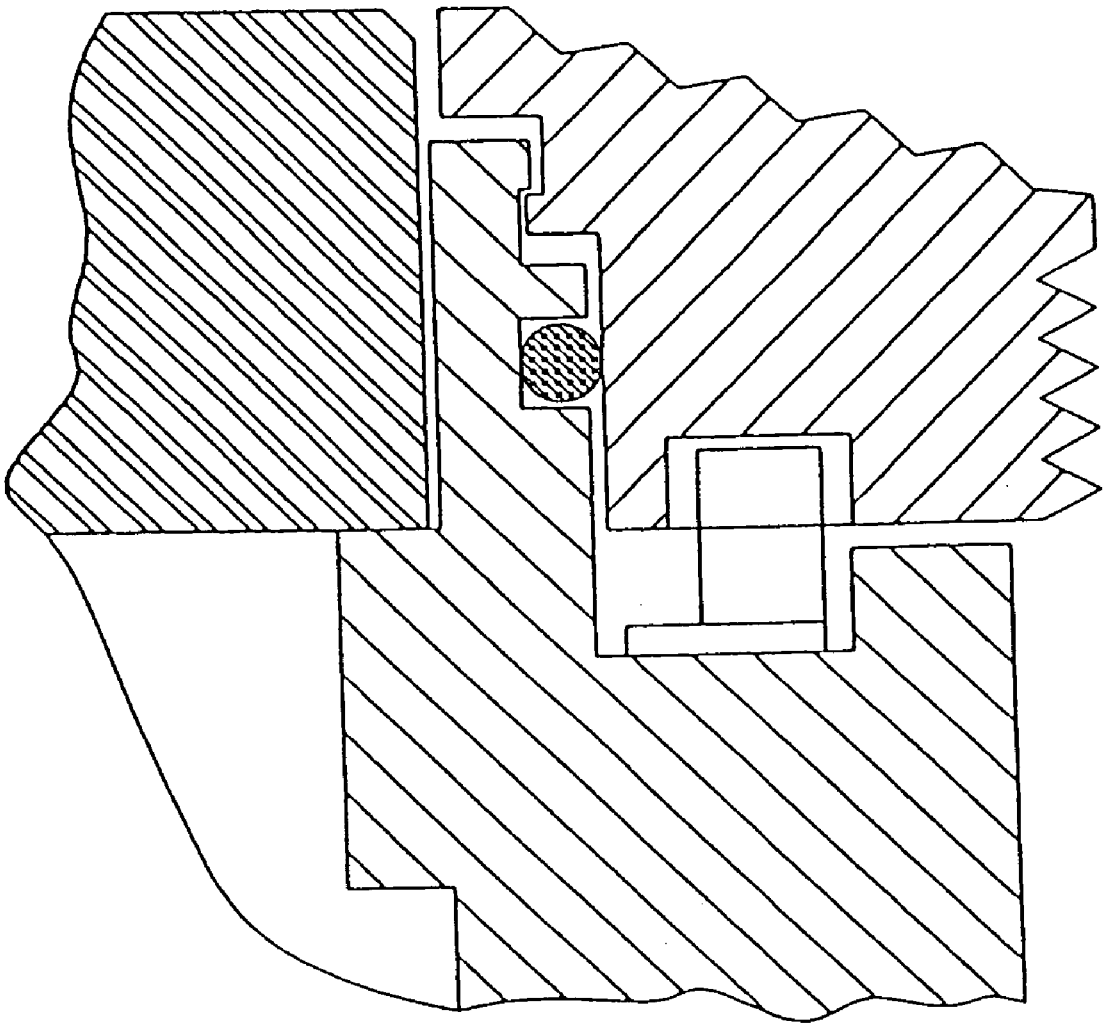
PRIOR ART FIG. 8
FIG. 8 is a principal-structure fragmentary sectional view of a conventional rotary bezel.

As a result of this, stop stability and rotation operationality are both provided in the conventional rotary bezel structure having no vertical change of position. As a result, contrary to the current situation wherein the rotary bezel requires a large rotation torque and wherein a concave-convex form is unavoidably required on a surface or peripheral portion of the rotary bezel to obtain sufficient rotation torque upon rotating the rotary bezel by the user's finger, as shown in FIG. 8, a wristwatch case having a rotary bezel was realized assuring stop stability and rotation ability without the necessity of providing a concave-convex form on a surface or peripheral portion of the rotary vessel. Also, because the rotation torque can be minimized, no pain or discomfort is felt in the user's finger during actuating rotation. Also, the design restriction of the rotary bezel requiring a concave-convex form is eliminated thus providing a great effect of increasing design freedom.

As shown in FIG. 5, it is possible to provide a click feel to free rotation of the rotary bezel 1 by causing slight interference due to the gear-formed concave-convex portion 13 and the click elastic protrusion portion 45 provided in the click elastic portion 44 in a state that the rotary bezel 1 is positioned in the upper stop point.

What is claimed is:

1. A watch case comprising: a case body; a bezel movably mounted on the case body for sliding movement between upper and lower stop positions and for rotational movement when the bezel is in the upper stop position; and a ring interposed between and extending circumferentially around the bezel and the case body, the ring having one or more first portions engageable with the bezel to prevent rotational movement thereof when the bezel is in the lower stop position, and one or more second portions engageable with the case body to prevent upward sliding movement of the ring when the bezel moves from the lower stop position to the upper stop position.

2. A watch case according to claim 1; wherein the ring has one or more third portions elastically engageable with a concave-convex portion of the bezel to impart a click feel to the bezel during rotational movement thereof.

3. A watch case according to claim 2; wherein the ring has a plurality of circumferentially spaced-apart first portions, second portions and third portions.

4. A watch case according to claim 2; wherein the one or more third portions each comprises an elastic protrusion.

5. A watch case according to claim 1; wherein the ring has a plurality of circumferentially spaced-apart first portions and a plurality of circumferentially spaced-apart second portions.

6. A watch case according to claim 1; wherein the ring is disposed in a circumferential space formed partly by the bezel and partly by the case body.

7. A watch case according to claim 6; wherein the ring has one or more projections each received in a hole formed in the case body to prevent rotation of the ring relative to the case body.

8. A watch case according to claim 1; wherein the one or more first portions of the ring each comprise a toothed portion engageable with a concave-convex portion of the bezel.

9. A watch case according to claim 8; wherein each toothed portion is located on an inner periphery of the ring.

10. A watch case according to claim 8; wherein the one or more second portions of the ring each comprise a lip portion engageable with a circumferentially extending wall portion of the case body.

11. A watch case according to claim 10; wherein each toothed portion of the ring protrudes radially inwardly and each lip portion of the ring protrudes radially outwardly.

12. A watch case according to claim 11; wherein the ring has one or more third portions elastically engageable with a concave-convex portion of the bezel to impart a click feel to the bezel during rotational movement thereof.

13. A watch case according to claim 12; wherein the one or more third portions of the ring each comprise an elastic protrusion which protrudes radially inwardly.

14. A watch case according to claim 13; wherein the ring has a plurality of first, second and third portions.

15. A watch case according to claim 14; wherein the third portions are alternately disposed around the circumference of the ring with respect to the first and second portions.

16. A watch case according to claim 15; wherein the first and second portions are disposed at the same circumferential locations around the circumference of the ring.

17. A watch case according to claim 16; wherein the first and second portions of the ring are disposed on lower and upper sides, respectively, of a plane passing through the ring.

18. A watch case according to claim 1; wherein the first and second portions are disposed at the same circumferential locations around the circumference of the ring.

19. A watch case according to claim 18; wherein the first and second portions of the ring are disposed on lower and upper sides, respectively, of a plane passing through the ring.

20. A watch case according to claim 1; wherein the ring is elastic.

* * * * *